US007914387B1

(12) United States Patent
Gugliotti

(10) Patent No.: US 7,914,387 B1
(45) Date of Patent: Mar. 29, 2011

(54) GOLF GAME APPARATUS AND METHOD

(76) Inventor: Rocco Gugliotti, Oakville, CT (US)

( * ) Notice: Subject to any disclaimer, the term of this patent is extended or adjusted under 35 U.S.C. 154(b) by 481 days.

(21) Appl. No.: 11/894,837

(22) Filed: Aug. 21, 2007

Related U.S. Application Data

(60) Provisional application No. 60/839,199, filed on Aug. 22, 2006.

(51) Int. Cl.
*A63B 69/36* (2006.01)

(52) U.S. Cl. ..... 473/174; 473/173

(58) Field of Classification Search ..... 473/150, 473/153, 165, 170, 173, 174, 180; 273/317.2; D21/789
See application file for complete search history.

(56) References Cited

U.S. PATENT DOCUMENTS

| | | | | | |
|---|---|---|---|---|---|
| 2,121,270 | A * | 6/1938 | Streich | ..... | 473/185 |
| 4,647,047 | A * | 3/1987 | Little | ..... | 473/187 |
| 4,878,671 | A * | 11/1989 | Gubany | ..... | 473/195 |
| 5,230,511 | A * | 7/1993 | Gubany | ..... | 473/196 |
| D346,831 | S * | 5/1994 | Adams | ..... | D21/790 |
| D400,631 | S * | 11/1998 | Moore | ..... | D21/791 |
| 5,857,919 | A * | 1/1999 | Hoyt et al. | ..... | 473/184 |
| D409,704 | S * | 5/1999 | Nunes | ..... | D21/791 |
| 6,283,873 | B1 * | 9/2001 | Nunes | ..... | 473/180 |
| 6,884,178 | B1 * | 4/2005 | Frost | ..... | 473/150 |
| 6,939,240 | B2 * | 9/2005 | Daley | ..... | 473/180 |
| 7,086,953 | B2 * | 8/2006 | Pinder | ..... | 473/174 |
| 2004/0180728 | A1 * | 9/2004 | Oirschot | ..... | 473/150 |

* cited by examiner

*Primary Examiner* — Raleigh W. Chiu
(74) *Attorney, Agent, or Firm* — James F. McLaughlin

(57) ABSTRACT

A fun and entertaining backyard lawn game related to the traditional game of golf. Players take turns striking their ball with a golf club from a plurality of designated tees towards a singular cup. Each player's ball is of a non-traditional design and changes the strategy and dynamics of play. The cup is also a non-traditional design with mechanical obstructions to the ball and on occasion may be adjusted by each player to impede the chances of a subsequent opponent from holing his ball in the cup. A winner is determined by a unique method of scoring.

10 Claims, 14 Drawing Sheets

GOLF GAME APPARATUS AND METHOD

A Provisional Application disclosing this entire invention was filed with the USPTO on Aug. 22, 2006 and issued an application number of 60/839,199 and this non-provisional application claims priority to that date.

BACKGROUND OF THE INVENTION

1. Field of the Invention

The present invention relates generally to backyard golf games and other similar lawn games, wherein the object is to propel a projectile into or as near as possible to a target marker. Such games provide a pleasant form of social entertainment. They are relatively easy to set up and generally can be played by young and old alike.

2. Discussion of the Related Art

Backyard games provide entertainment and friendly interaction for diverse groups of people ranging in all ages. A subclass of these games are based on or related to the traditional game of golf which is played on a conventional nine or eighteen hole outdoor grass golf course.

Conventional golf courses, however, require large parcels of land to accommodate the distances achievable by a single stroke on a conventional ball. Backyard golf type games must be designed so they are playable within a much more limited space. Some games achieve this by using plastic golf balls and or plastic golf clubs thus greatly reducing the potential distance a fully struck ball may achieve. However the plastic clubs do not simulate the true feeling of swinging a regulation golf club, and plastic balls do not exhibit the same kinetic and aerodynamic characteristics of a regulation ball due to less mass.

In light of the foregoing, there is a need for an outdoor target golf style game which incorporates the use of real golf clubs and uniquely designed balls having more mass than plastic balls. This new invention further incorporates scoring concepts such as a hole in one, eagle, birdie and bogey for example, while providing enjoyment, entertainment, quantifiable feedback and competitive motivation for players of varying skill and ability. There also exists a need for an outdoor target golf game available for play without the need for time-consuming setup or preparation and without the need for attendants or caddies. There is a further need for an outdoor target golf game capable of being played by relatively large groups of players and according to an uncomplicated, easily comprehensible system of rules and scoring Yet an additional need exists for an outdoor target golf game which may be installed as an essentially permanent facility having the attributes of simplicity and economy.

SUMMARY OF THE INVENTION

Accordingly, it is an object of the present invention to overcome the aforementioned disadvantages of prior target golf courses and games.

Another object of the present invention is to provide a safe, enjoyable party game playable by children and adults alike.

Another object of the present invention is to provide a game which can be quickly and easily set up, typically in less than one minute, and played in a multitude of backyards or lawns differing in size, shape, and terrain.

Another object of the present invention is to provide a game whose entire pieces and parts are easily transported in a small container so that one may take the game to a park, public field or friend's home.

Another object of the present invention is to enhance the practice opportunities available to golfers analogous to traditional golf.

An additional object of the present invention is to improve the practice opportunities available to golfers for chipping and pitching.

A further object of the present invention is to provide quantifiable feedback to a golfer for skills executed during practice.

It is also an object of the present invention to allow a golfer to gauge actual performance and improvement during practice.

Moreover, it is an object of the present invention to incorporate a variety of practice scenarios in an outdoor target golf course and game to competitively motivate the practice of various skills by players of various levels of skill and ability.

The present invention has as another object to provide an outdoor target golf course and game having the characteristics of structural and operational simplicity, versatility and economy while being compatible with the conditions and concepts of traditional golf.

Additionally, it is an object of the present invention to utilize repetition to foster skill development and improvement in shots taken at predetermined distances from a target hole in an outdoor target golf game.

Yet a further object of the present invention is to provide an outdoor target golf course and game combining skill execution and the opportunity for physical conditioning applicable to traditional golf.

The foregoing objects are achieved individually and in combination, and it is not intended that the present invention be construed as requiring two or more of the objects to be combined unless expressly required by the claims attached hereto.

Some of the advantages of the present invention are that the outdoor target golf course and game enable the accuracy of each shot to be determined; the outdoor target golf course and game allow weaknesses warranting further practice to be identified; the outdoor target golf course and game present a challenge for players ranging in skill and ability from beginners to experts and allow beginners and experts to play together under comparable conditions; beginners and other players can acquire and/or improve on basic golf skills for utilization in the traditional golf game; the repositioning of holes and/or flags is not required; the outdoor target golf course and game can be laid out within peripheral borders of various shapes and sizes; natural features and/or topography can be incorporated in the outdoor target golf course and game to provide obstacles and/or conditions for practicing particular skills; natural features and/or topography can be employed in the outdoor target golf course and game to provide various levels of difficulty; ordinary lawn grass may be used predominately as the playing surface such that bounce, roll and other ball actions replicate traditional golf; the outdoor target golf game is played with regular golf clubs applicable to traditional golf, over sized balls are marked or colored to remain conspicuous; the loss of balls is essentially eliminated; a variety of obstacles or hazards may be incorporated in the outdoor target golf course and game; predetermined distances established between the tee stations and the target hole enhance the value of informational feedback to the players; the target area typically comprises a single target hole identifying the target that players are to hit to; the use of a single target hole ensures that the target is clearly distinguishable to players; in an alternative embodiment each player may complete his/her own score card similar to traditional golf; scoring is conceptually similar to traditional golf in that low scores are more favorable than high scores; motivation and encouragement are maintained for less skilled players; more than one golfer can hit to the target hole from a tee station at the same time thereby increasing the pace and reducing the time required to complete a game; the outdoor target golf course and game may be laid out on a relatively small parcel of land, such as an average backyard of a home or condominium; the outdoor target golf course and game is well-suited for installation in parks, recreation areas and as an adjunct to traditional golf courses; beginner players in particular may acquire basic golf skills from the outdoor target golf course and game prior to playing on a traditional golf course for the first time; and, by increasing the confidence and skill in beginner and other players for traditional golf, the outdoor target golf course and game make it more likely such players will develop a long-term commitment to participation in traditional golf.

The above and other objects, features and advantages of the present invention will become more apparent from the following description of a preferred embodiment taken in conjunction with the accompanying drawings wherein like reference numerals refer to like or similar parts.

BRIEF DESCRIPTION OF THE DRAWINGS

The present invention can be readily understood by considering the following detailed description in conjunction with the accompanying drawing, in which.

DETAILED DESCRIPTION OF THE PREFERRED EMBODIMENTS

In general many of the terms used within have similar meanings to their usage in the well known game of golf. Where there are unique differences as to the usage of the word or phrase, it will be noted within this specification.

For example the word 'tee' is used herein in its common form to identify a physical area where a golfer begins his play on a particular hole. A 'hole' identifies the area of play from one particular tee to the cup. In this invention it should be noted that there is typically only one cup which is used for all holes, that is to say, no matter where you tee off in this game, you are always playing to the same physical hole. However given that a player may set each of the nine tees in a different location, the play to the cup will vary according to the terrain and obstacles between each particular tee and the cup. 'Course' identifies the entire area of play.

Figure 1:
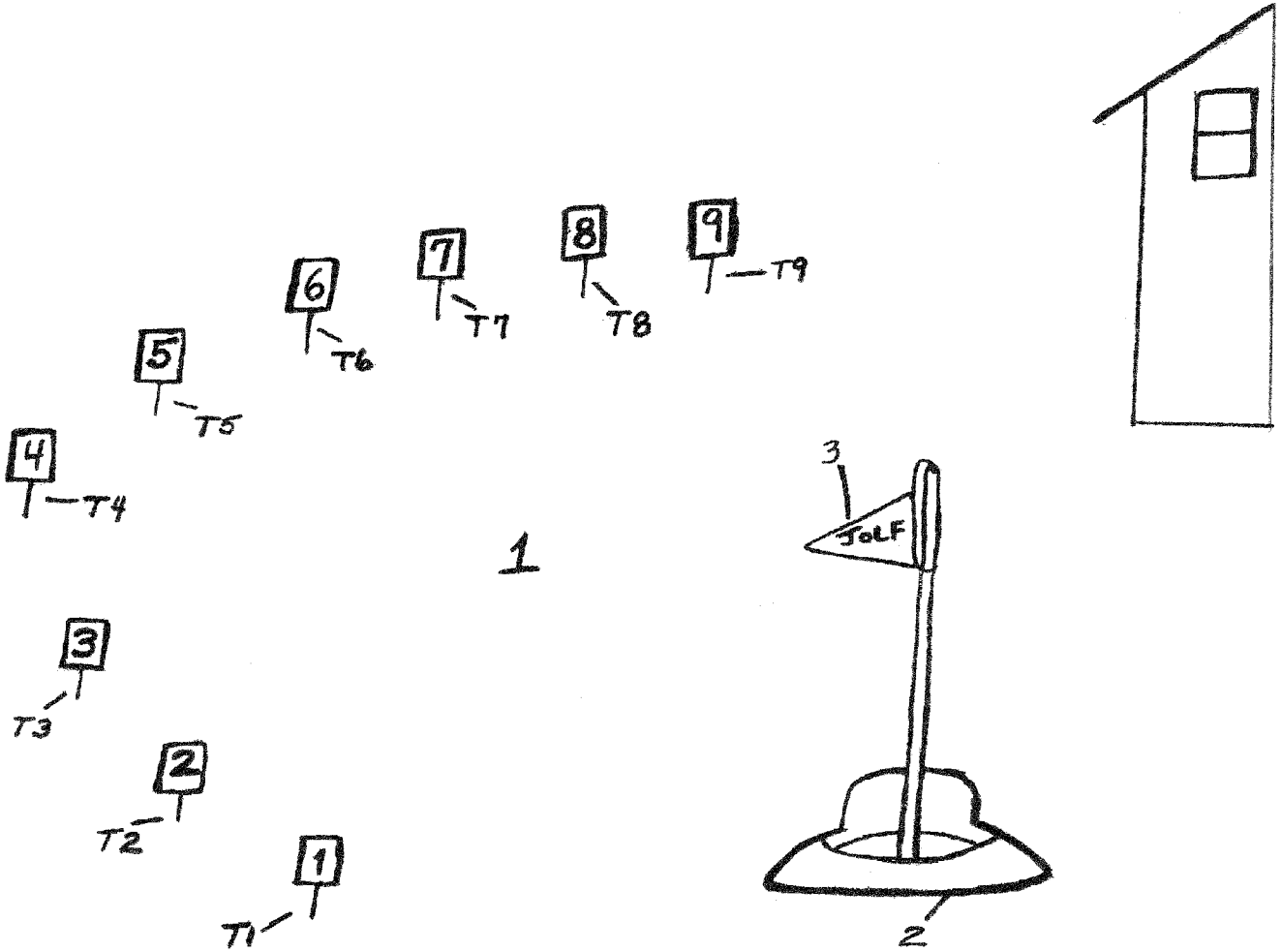
FIG. 1 depicts a backyard perspective view of the game layout in accordance with the present invention.

FIG. 1 shows the general layout of a first embodiment of the invention in a player's backyard 1 of the game. There are nine separate tees T1, T2, T3, T4, T5, T6, T7, T8, & T9 numerically labeled 1 through 9 which are placed in various locations throughout the yard. Each tee is a location marker and designates the general lawn area where each player must place his ball to start playing that particular hole.

A singular 'cup' 2 is marked by the 'Jolf'™ flag 3 flying above it. There is one and only one cup 2 on this particular course. Each hole terminates at this singular cup 2. A 'hole' is defined as play commencing from any one of the singular tees and terminating at the cup 2. Play terminates on each hole when all of the players have moved their ball into the cup 2. Then all of the players move on to the next sequentially marked tee to commence play on the next hole. The game is complete when all players have played all of the holes, or more specifically have played from each and every tee T1, T2, T3, T4, T5, T6, T7, T8, & T9 to the cup 2.

Figure 2:
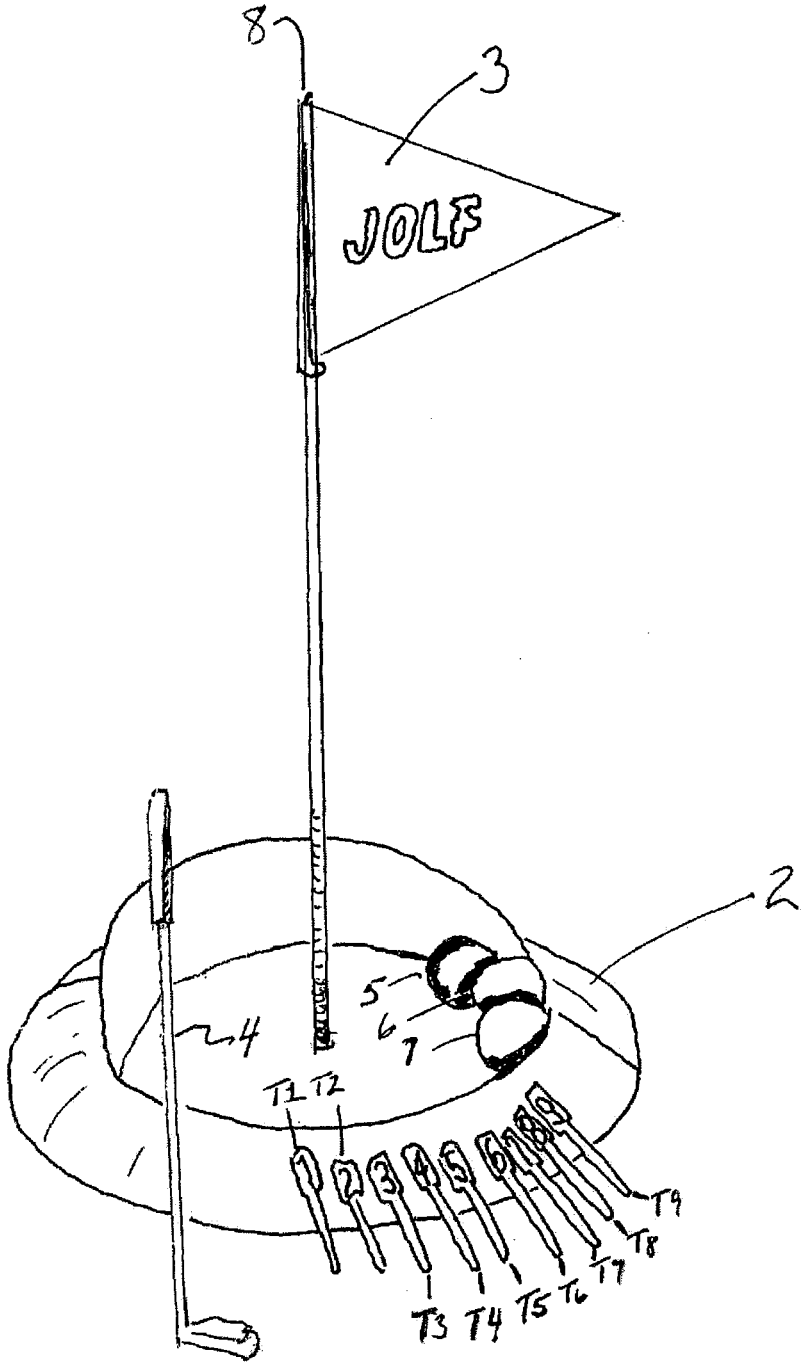
FIG. 2 is a photograph showing the equipment used in the invention.

FIG. 2 is a color photograph showing all of the equipment necessary to play the invention. The cup 2 is shown with three differently colored balls, red 5, blue 6, and yellow 7 at rest in the scoring position, that is, inside of the cup 2. Rising up vertically from the center of the cup 2 is a flagpole 8. Attached to the top of the pole 8 is the Jolf™ flag 3. Also laying on the perimeter left edge of the cup 2 is regular golf club 4. This is the necessary minimum equipment to play the game of Jolf™ in this embodiment.

The Tees

In general a player or players will start at tee number '1' T1 as shown in FIG. 1 and play towards the cup 2. Scoring and the precise method of play will be described below.

As shown in FIG. 2, the tees T1, T2, T3, T4, T5, T6, T7, T8, & T9 are stakes designed and manufactured so as to be easily inserted into lawn turf by anyone, including a young child or elderly person. The stakes can be made of plastic or metal. The important feature is that they are narrow enough to penetrate the lawn without tremendous force. Each tee has a unique number starting with the number one and labeled sequentially through and including the number nine. The numeric label may be on multiple surfaces of the tee and is designed to be visible from all directions so that players are able to identify each tee from anywhere on the course.

In a second embodiment, multiple cups 2 maybe set out on a lawn separated by an appropriate distance. Each cup 2 or its annular ring 12 will be of a unique color to distinguish it from another, so they may be verbally labeled as the 'blue hole' or the 'red hole'. Each different color coded cup 2 will have a matching set of color coded tees as well, so that players know to play from a 'blue tee' to the 'blue hole' and from a 'red tee' to a 'red hole'.

A simple embodiment of multiple cups 2 is similar to horseshoes where in two cups 2 are set on the playing surface separated by an appropriate single hole playing distance and play commences from a tee in close proximity to a first cup yet towards the second cup. Once all players have played to the second cup, they next commence play from a tee in close proximity to the second cup back to the first cup. In this manner players are maximizing their play over the distances they are walking.

The Target

Figure 3:
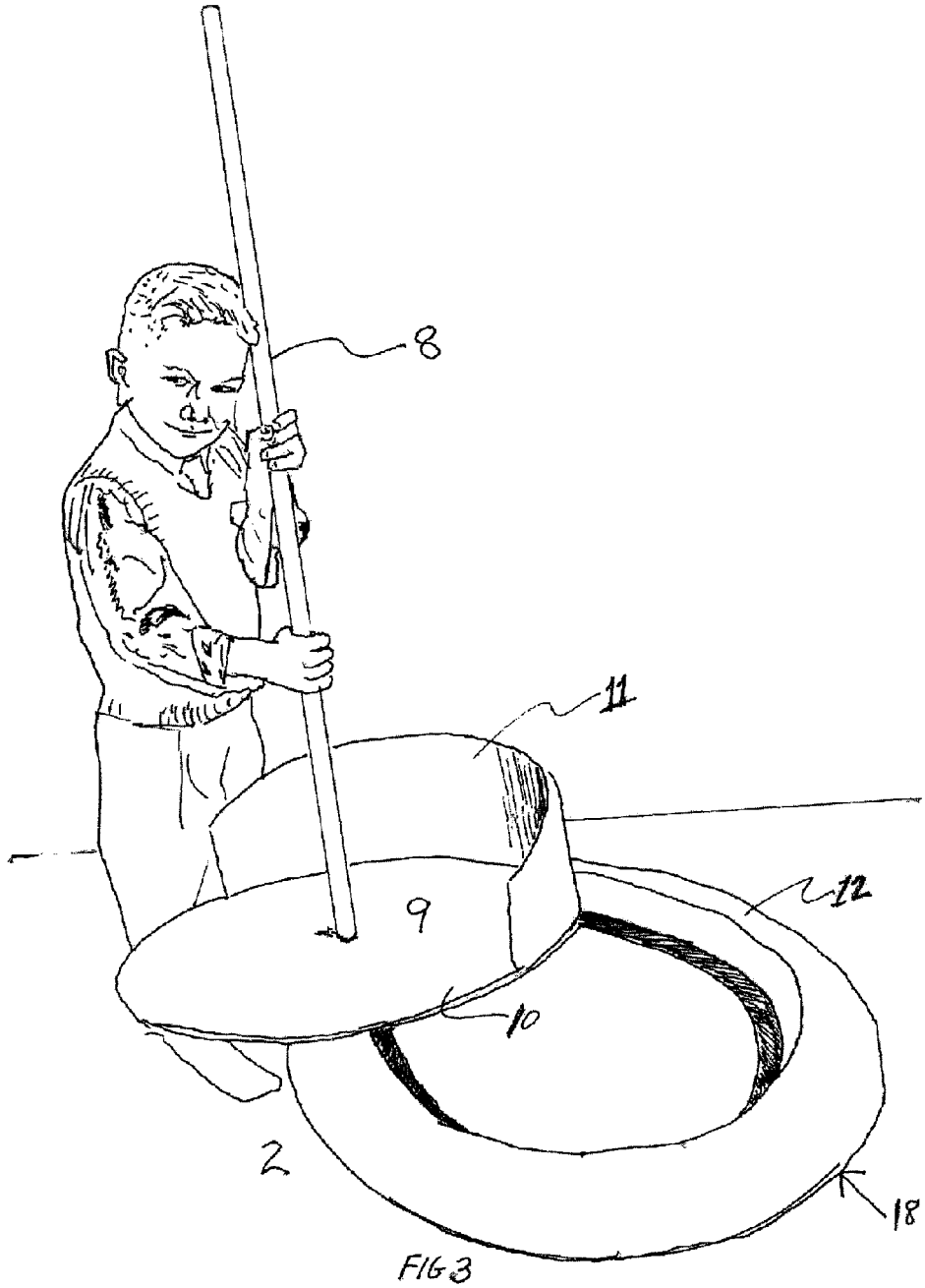
FIG. 3 is a photograph showing the target of the invention.

The cup 2 as shown in FIGS. 1 & 2 includes several features which impact the manner and strategy of the game. Referring now to FIG. 3, the cup 2 is shown in a disassembled form. The aforementioned flagpole 8 is mechanically attached to the backstop 9. Here the young man is shown lifting up the backstop 9 by the flagpole 8. The backstop 9 is very lightweight and it is intended that players may lift and rotate the backstop 9 by manually grabbing the flagpole 8 and rotating its shaft.

As can be seen the backstop 9 is comprised of two structures. The first is a circular disk 10. The flagpole 8 attaches directly to the center of the circular disk 10. On the perimeter of the circular disk 10 is a vertical semi-circular fence 11 which partially encloses the circular disk 10. In this embodiment, the fence 11 extends vertically along approximately 40% of the perimeter of the disk 10. The circular disk 10 is designed to easily fit into and out of the circular donut 12. The circular disk 10 also has an arrow 16 printed on its top surface. The arrow 16 points directly away from the fence 11. The arrow 16 may be painted any prominent color or design.

Figure 4B:
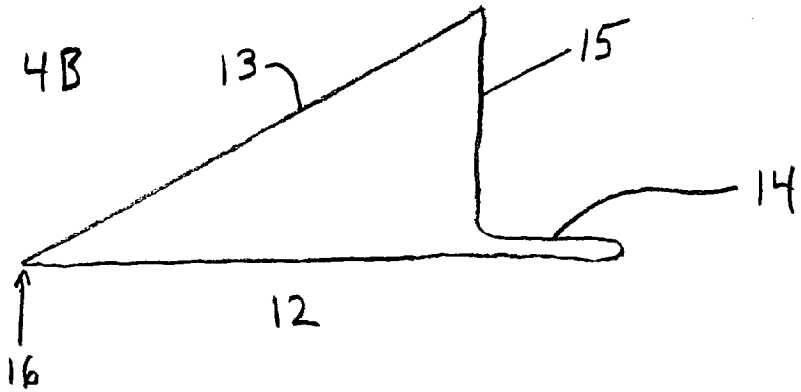
FIG. 4B is a drawing showing a cross-section of the target donut ramp.
Figure 4A:
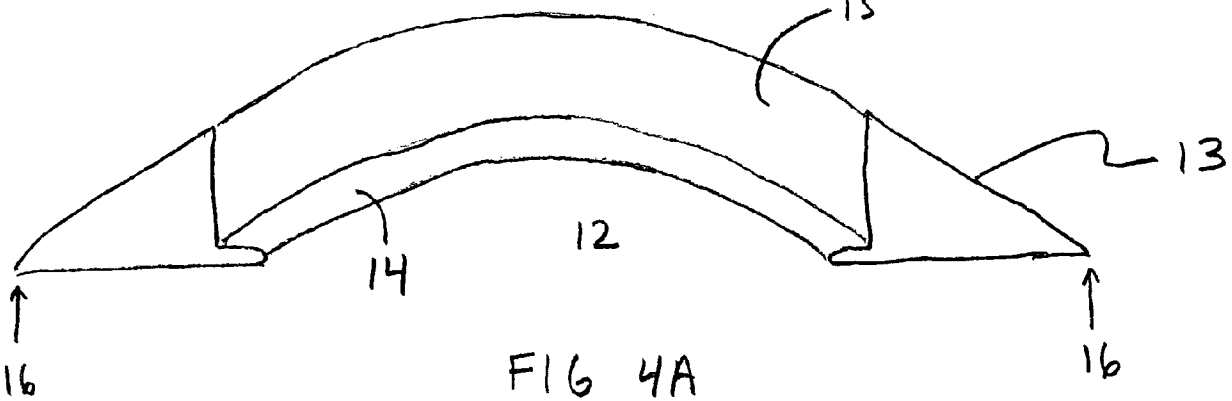
FIG. 4A is a drawing showing a cross-section of the target donut.

Referring now to FIGS. 4A & 4B, cross-section views of the circular donut 12 are shown. In FIG. 4A a perspective elevation view of a cross-section of the circular donut 12 is shown. It is comprised of a ramp 13 on the outside circumference of the donut 12, and a lip 14 and vertical wall 15 on the interior circumference of the circular donut 12. These features are also clearly shown in FIG. 4B.

As can be seen by referencing FIGS. 3, 4A & 4B, the backstop 9 is lowered into the donut 12 so that the disk 10 rests upon the lip 14 of the donut 12. When a player lifts the backstop 9 up a few inches and rotates it about its shaft, the disk 10 easily rotates in the space between the disk 10 and the vertical wall 15. It should be clear by now that such rotation, if anything other than 360° or multiples thereof, will cause the fence 11 to come to rest in a new position with respect to any of the fixed tees T1 through T9 as shown in FIG. 1. Such rotation will be further described below.

Figure 5:
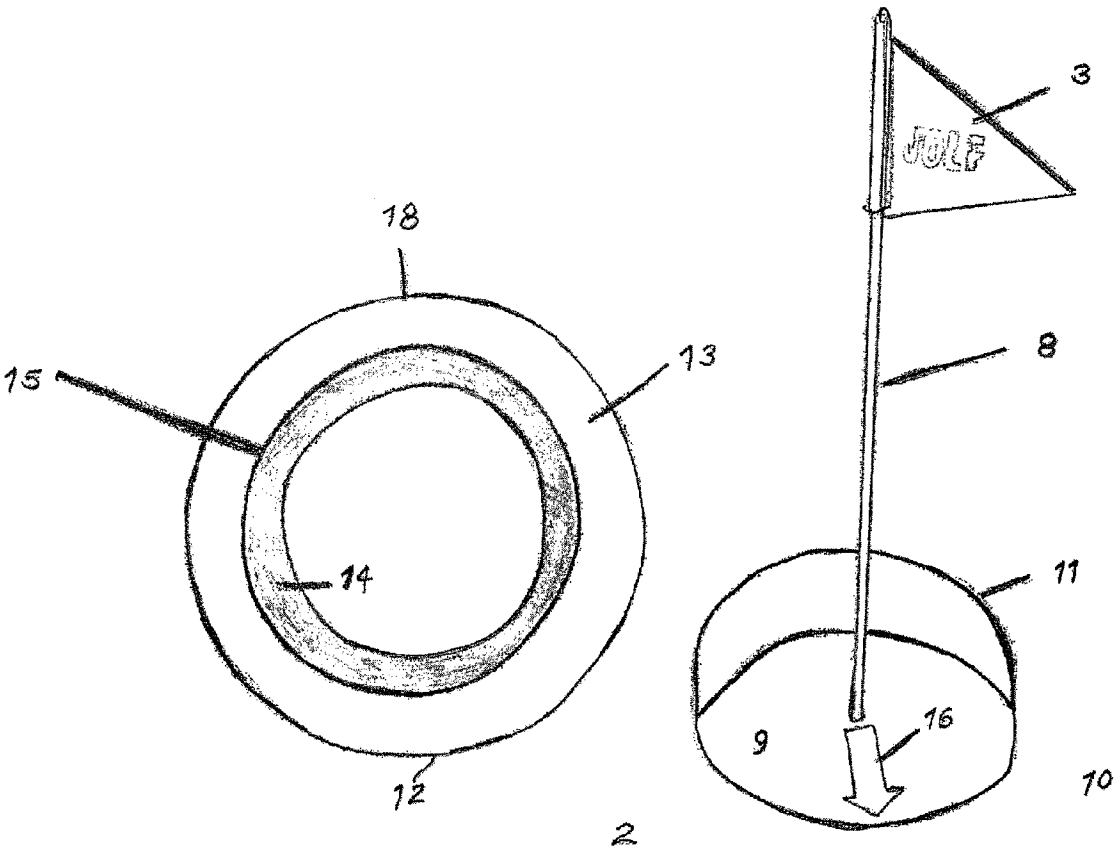
FIG. 5 is a photograph showing the target of the invention.

Referring now to FIG. 5, a perspective view is shown of the disassembled cup 2 with the donut 12 on the left side and the backstop 9 on the right side of the photograph. Given that the backstop 9 and flagpole 8 and flag 3 are of very lightweight construction, it is obvious how one can simply position the backstop 9 into the donut 12 with a single human hand grasping the flagpole 8.

As for preferred dimensions of the cup 2 in this embodiment, the outside circumference of the donut 12 has an approximate diameter of 32" in. The interior circumference of the donut 12 as measured from inside vertical wall 15 to opposite inside vertical wall 15 is approximately 19". The height of the vertical wall 15 is approximately 3.5". As mentioned above the diameter of the circular disk 10 is slightly less than the interior circumference of the donut 12 so as to allow almost frictionless rotation when raised by the flagpole 8. The curved fence 11 is approximately 8" tall from the disk 10 so that once seated in the donut 12, the fence protrudes vertically above the ramp 13 for another 4 to 6 inches.

Referring to FIGS. 3, 4A, 4B & 5, a rim 18 is shown on the donut 12. The rim 18 includes the entire peripheral edge of the donut 12. The ramp 13 begins at the rim 18 and continues to the top edge of the vertical wall 15.

Thus the cup 2 is round with a 4" high ramp 13 surrounding the entire hole forming an inclined runway accessible from all directions. The ramp 13 forces a player to hit his ball with enough energy that it will roll up the entire ramp 13 and fall into the hole or that the player must chip the ball over the ramp 13 and into the hole.

The ball may roll up and over the incline, (assuming the backstop is not strategically placed to hinder the shot) into the target, scoring points.

Additionally, there is a backstop used to stop the ball from rolling out of the target, or to hinder an opponent from making a shot.

Although one target is sufficient for a group of players to play 18 holes, it is envisioned that multiple targets may be set up in a single playing area so as to enhance the playing environment. The arrangement could be the typical 'front nine' and 'back nine' (with one target for each set of holes) or it could be more creative, for example, odd numbered tees play to a first target and even numbered tees play to a second target. There is no limitation on the number of targets which can be included in the game.

The Flagpole and Flag

The flagpole 8 as shown in FIGS. 3 & 5 has a preferred length of 4 feet. It is designed so as to be disassembled into two pieces for transport. The flagpole 8 can be assembled by several different mechanisms. For example one may thread a top shaft into a bottom shaft creating the four foot flagpole 8. Another example is that the pole sections maybe fabricated for a slip joint where one may slip one smaller diameter tube end into a receiving end on the second tube as commonly known in the art. Next the flagpole 8 is mechanically connected to the disk 10 at one of its ends. It further receives a flag 3 at the opposite end.

Figure 11:
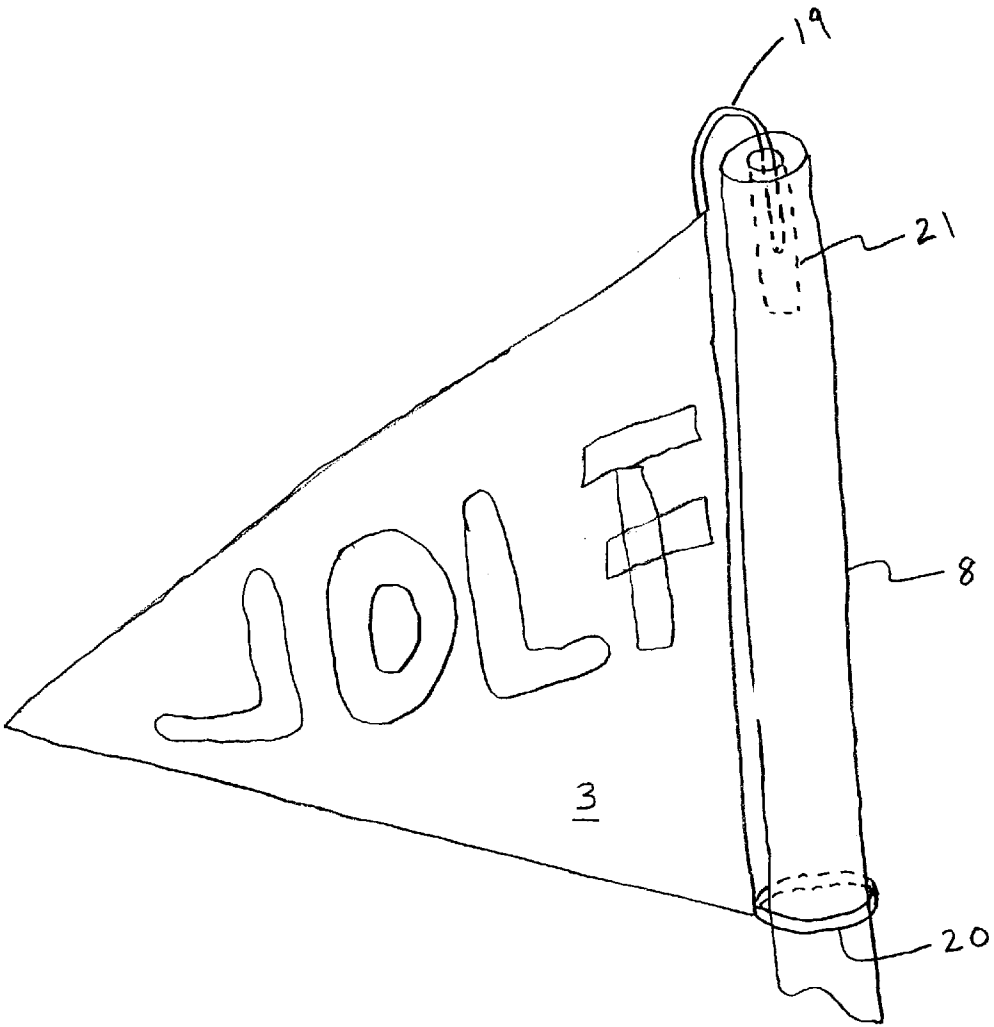
FIG. 11 is a drawing showing a the flag attached to the flagpole.

Referring to FIG. 11 the flag 3 is shown hanging from the top of the flagpole 8. The method of attachment allows the flag to rotate freely and reduces any wind resistance which may induce toppling over of the cup 2.

A circular wire loop 20 is mechanically attached to the bottom of the flag 3 and slides over the top of the flagpole 8 upon installation. This allows the flag 3 to slide down the pole 8 and also allows for complete 360° rotation of the flag 3.

On top of the flag 3 is a wire hook 19 which is mechanically attached to the top of the flag 3. The hook 19 slides into the post hole 21 that has been drilled into the top end of the flagpole 8. The hook 19 rests comfortably inside the hole 21 and also allows for complete 360° rotation of the flag 3.

Construction Materials

It is critical to the enjoyment of players that the cup is made of lightweight materials. The flag 3 rotates on the flagpole 8 and thus does not cause significant aerodynamic drag so at to cause concern of the cup 2 tipping over on a windy day. The circular donut 12 and backstop 9 may be made out of card cardboard, fiberglass and paint in one embodiment. In a second embodiment such equipment may be constructed from plastic and or polypropylene materials.

The Balls

The balls 5-7 as depicted in FIG. 2 are made from polypropylene and are approximately three and one-half inches in diameter. Although the dimension of the balls may vary for other playing conditions, it has been empirically determined that this is the best practical size so as to get the best roll on grass surfaces. It is understood that the ball dimensions may be varied for different locations or climates where the texture on length of grass lawns may require either a smaller or larger ball.

Figure 14:
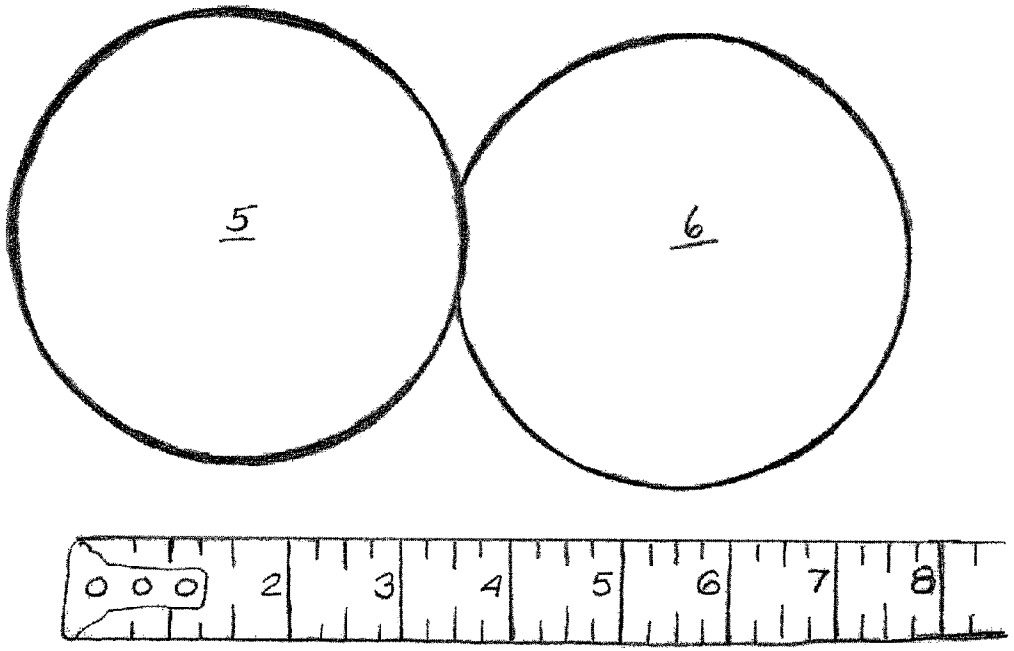
FIG. 14 is a photograph showing some playing balls.

Referring to FIG. 14, a photograph of the balls 5 & 6 is shown. Notice the dimensions of the balls in accordance with the ruler shown. It is the size of the balls along with their mass that makes them play so well on a lawn surface.

Each ball is made of polyurethane, polypropylene, or other resilient material and weighs approximately 2.0 to 4.0 ounces.

It should be noted that the balls may be made from other materials that may change the size, weight, and resiliency of the ball, but the object will be to fabricate or select a ball that has the appropriate mass and inertia to play well on lawns and with the novel target.

The Club

As shown in FIG. 2 the club used is a regular golf club 4, the seven iron being preferred by the inventor as the best all around club to hit the ball far or for short strokes, although it is recognized that different players may have a preference for using different clubs. In fact an eight or nine iron work very well in the game as does a pitching wedge.

Each player is allowed to use any club he desires. He may also change clubs of often as he wishes so long as he does not unnecessarily impede the progress and enjoyment of the game.

Included in the game are 9 tees (start markers) numbered 1 thru 9 on one side and 10 thru 18 on the other side. These are planted into the ground at various spots before play begins.

Object of the Game

The object for each player is to stroke the ball into the cup in the least amount of strokes over a series of holes to gain the most points of all the players.

Game Setup

The game is played preferably on a grass surface, but may be played on any natural type surface, such as a beach, a park or a campground. Your imagination is the limit. The marking tees T1-T9 may be placed very close together (10 to 20 feet) or very far apart (100 yards or more). The course may go through woods, trees, or around a pond, a barn, or a house.

A preferred place to set up the course and play is a well-manicured lawn area of about 60×80 feet.

Place the donut 12 on the grass and press it down carefully onto the ground making sure it is stable and secure from moving or sliding (optional fastening pegs 22 may be used). Assemble the flagpole 8 to the disk 10 and place the backstop 9 into the donut 12. Place the flag 3 onto the flagpole 8.

Figure 13:
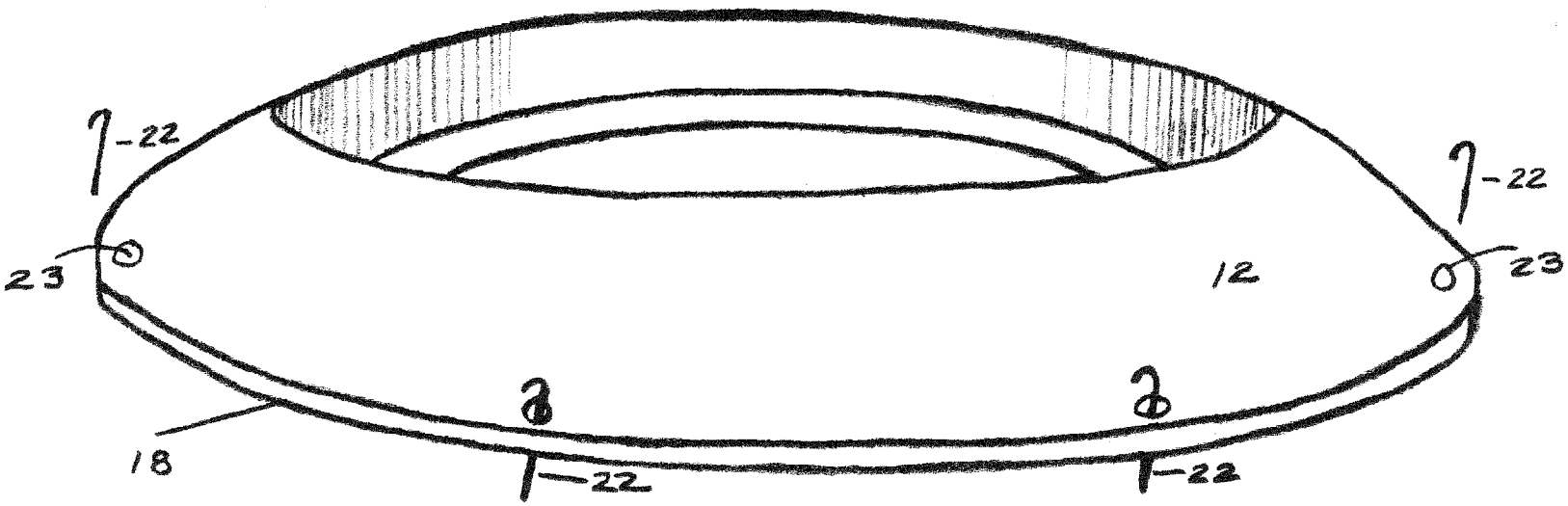
FIG. 13 is a drawing showing a target donut and fastening pegs.

Referring to FIG. 13, the optional fastening pegs 22 are shown which are usually only necessary for playing on slippery surfaces, such as ice, snow, gravel, sand dunes or on a sloping hill where sliding or toppling may be a concern. The pegs 22 are driven through the holes 23 near the rim 18 of the donut 12 and into the ground to secure the target.

Place the nine tees T1-T9 at different distances thru out the playing area.

Have each player select a uniquely colored ball as his own. Have each player select a club of his choice. Draw straws to determine the teeing off order.

Position the backstop 9 so that the arrow 16 points directly towards tee number one T1.

You are now ready to play.

Method of Play

Typically one to four players may play, but the number of players is not limited.

Play begins at the first tee T1 and continues through all of the tees in a sequential manner.

To start, the first player's ball is placed anywhere within 1 club length of the first tee T1. The first player then strikes the ball with his club towards the cup 2.

The next player in the order takes his shot from the first tee T1. This step is repeated until all players have played their ball once.

If the group is playing 18 holes, before leaving the $1^{st}$ tee marker T1, spin the $1^{st}$ tee marker T1 around so that it shows "$10^{th}$ hole". Therefore, the $1^{st}$ tee marker becomes the $10^{th}$; the $2^{nd}$ tee marker T2 becomes the $11^{th}$ etc.

At all times, farthest player from hole continues play. If someone strikes the ball and still is the farthest away from the hole, he strikes again until he is not the farthest away.

Each player has the right to move (turn) the backstop 9 one time per hole. The backstop 9 may be moved to make a particular shot easier for that player or may be used to block out another player.

Each player counts the number of strokes into the hole.

Once a player strokes his ball into the hole he removes his ball immediately and announces his score for that hole.

Lowest number of strokes per hole determines whether one gets points or not.

Moving the backstop 9 during a particular hole means a player is "dirty" and can only get 1 point for that hole if he has or ties the lowest number of strokes for that hole.

Figure 6:
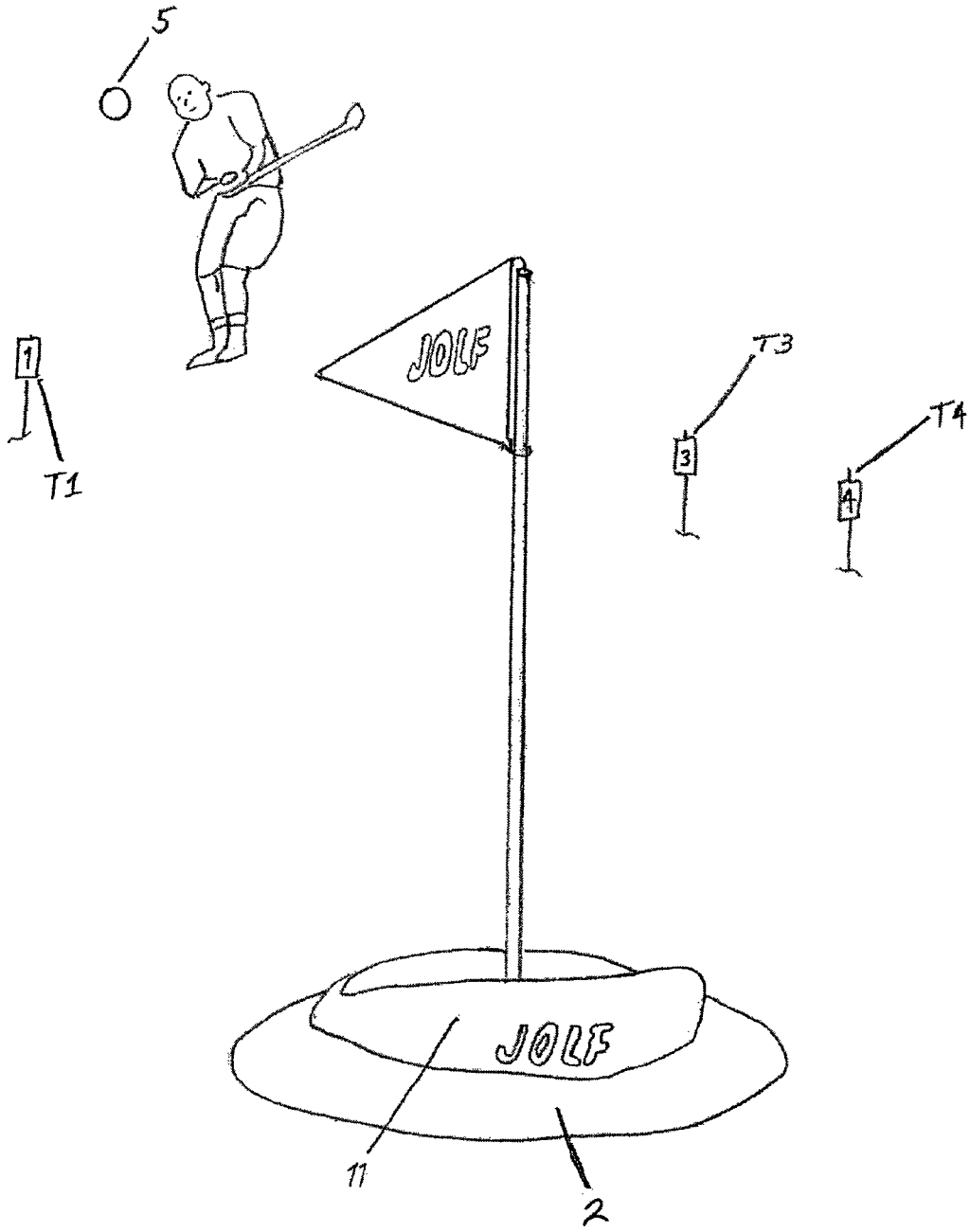
FIG. 6 is a photograph showing a player teeing off.

Referring now to FIG. 6, a player is shown taking his first shot from the tee T1 towards the cup 2. The player's red ball 5 is shown in the air next to the player's head enroute to the cup 2. The backstop 9 has been positioned so that the fence 11 is away from the tee T1 allowing the player his best chance to get a hole in one.

Figure 7:
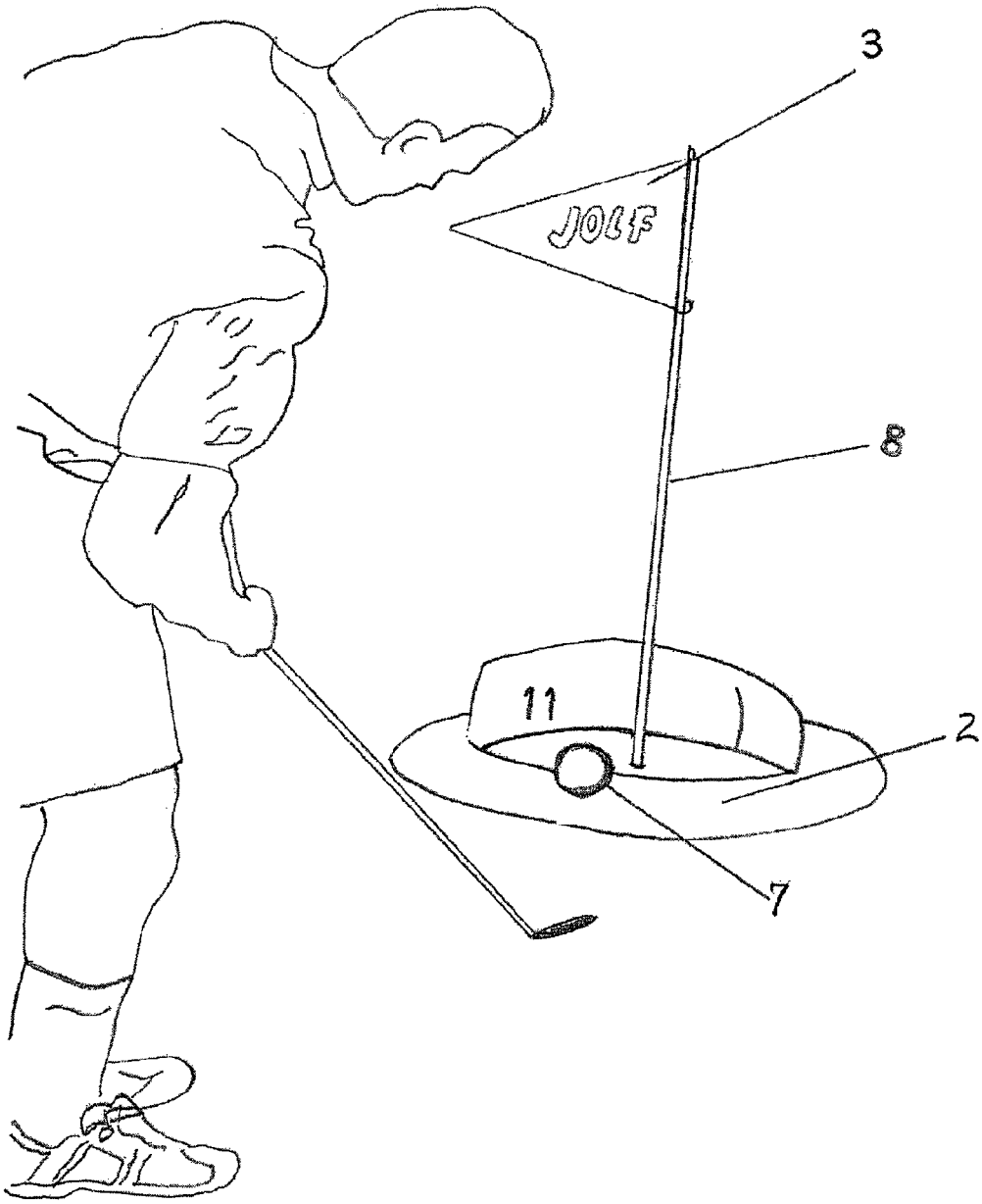
FIG. 7 is a photograph showing a player chipping into the target.

Referring now to FIG. 7, a player is shown chipping the yellow ball 3 into the cup 2. Again notice the position of backstop such that the fence 11 is away from the player allowing him his best chance to sink the ball 3 into the cup 2.

Figure 8:
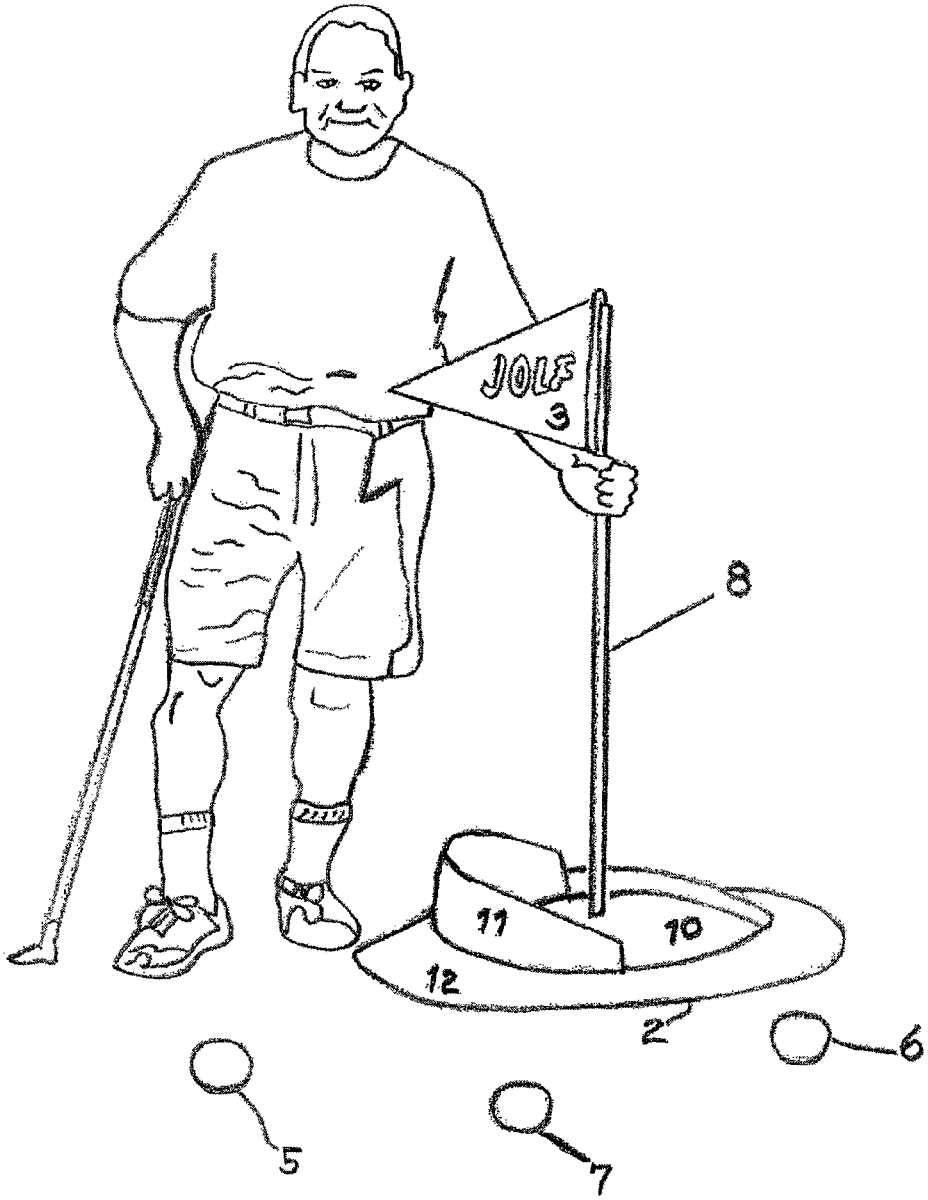
FIG. 8 is a photograph showing a player rotating the backstop.

Referring now to FIG. 8, a player is shown with the cup 2 and balls 5-7. The player stands in the position for manually rotating the backstop 9 as described below. Such rotation will cause the fence 11 to be positioned at any desirable angle so as to allow or obstruct a path of flight for any particular ball 5-7.

Point Scoring

Points are awarded to players on each hole according to the following schedule:

Any player who shoots an Ace (Hole-in one) receives three (3) points.

The player(s) with the lowest stroke count receives either one or two points depending on whether they moved the backstop 9.

If the player did not move the backstop 9 during the hole he receives two (2) points If the player did move the backstop 9 during the hole he receives one (1) point.

To summarize points a player may receive on a hole:

| Strokes Count | Points |
|---|---|
| Any player shooting a Hole in One (1 stroke) | 3 |
| Player with lowest stroke count and DID NOT MOVE backstop | 2 |
| Player with lowest stroke count and DID MOVE backstop | 1 |

Strokes Count Points

Any player shooting a Hole in One (1 stroke) 3 Player with lowest stroke count and DID NOT MOVE backstop 2 Player with lowest stroke count and DID MOVE backstop 1

If the lowest stroke count on a hole is tied between players, all such players receives points in accordance with the above table.

The following terminology may be used by players to describe their play on any particular hole:

1 Stroke=Ace

2 Strokes=Bird

3 Strokes=Triple

4 Strokes=Four (etc)

Scoring Examples

The following examples of play are offered to exemplify the scoring method of this game.

Hole 1 Results and Scoring.

Player 1 holes in 3 strokes and he moved the backstop. (Dirty triple)

Player 2 holes in 3 strokes and did not move the backstop. (Clean triple)

Player 3 holes in 4 strokes and did not move the backstop. (Clean four)

Player 4 holes in 4 strokes and he moved the backstop. (Dirty four)

Lowest numbers of strokes are players 1 and 2, so they both receive points.

Player 1, dirty triple is 1 point.

Player 2, clean triple is 2 points.

Figure 12B:
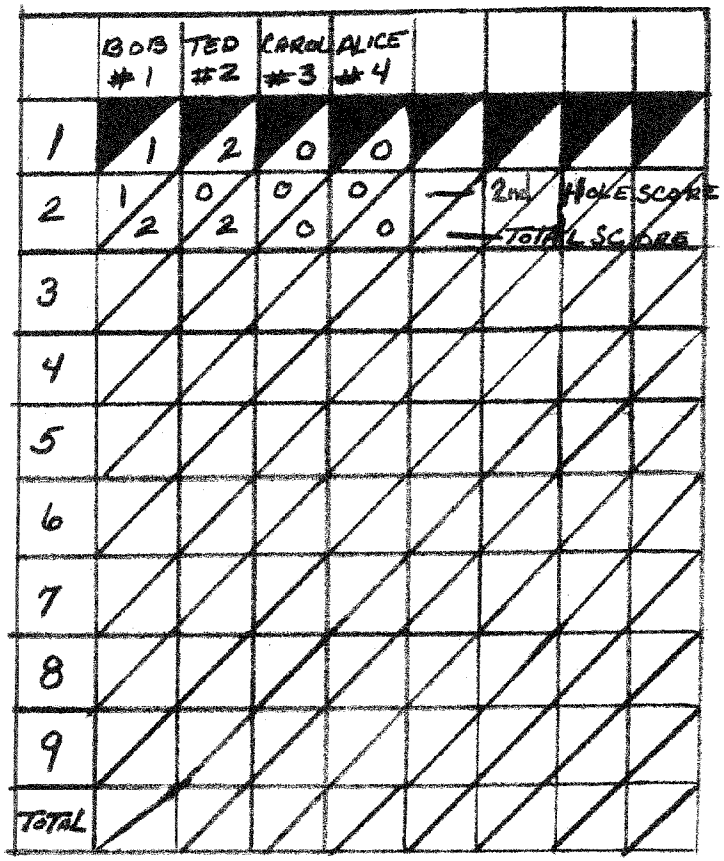
FIG. 12B is a drawing showing a scorecard with entries for two holes.
Figure 12A:
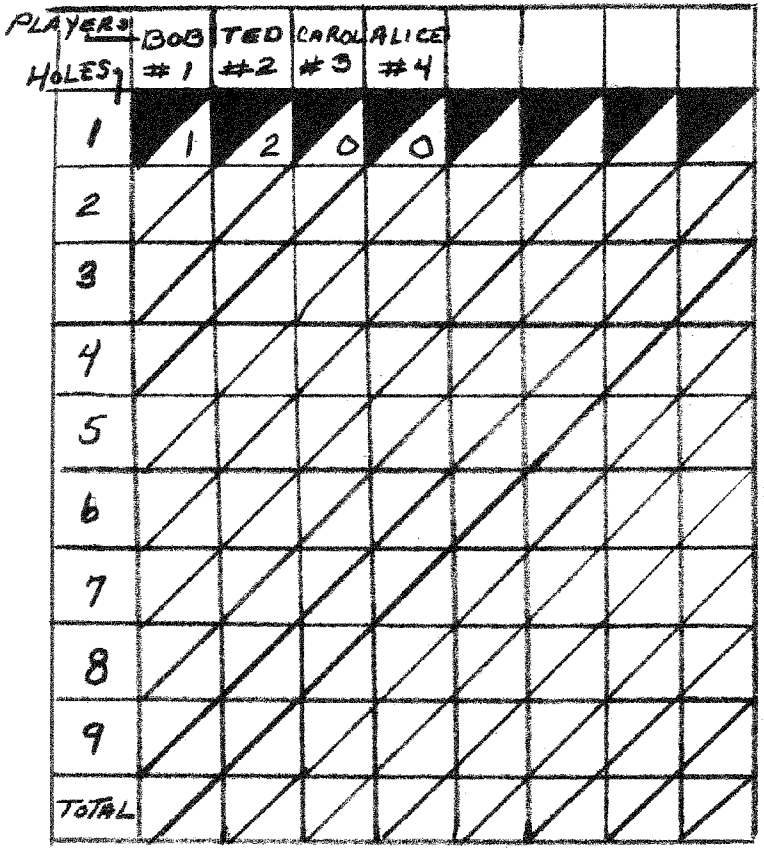
FIG. 12A is a drawing showing a scorecard with entries for one hole.

Referring now to FIG. 12A, a scorecard is shown. Each row of the scorecard is for a specific hole. In this example row 1 is for Hole No. 1 and row 2 is for Hole No. 2. Each column is for a specific player.

The intersection of a row and a column results in a scoring box. Each scoring box on each row of the scorecard is divided by a diagonal line. This is so two entries may be made for each player on each hole excepting the first row ($1^{st}$ Hole). The top of the scoring box is to enter the score for that particular hole and the bottom of the scoring box is to enter the player's total number of points to that completed hole.

The first row of the scorecard has the top scoring box blackened because it is the first hole and there is no prior score to carry forward.

Referring now to FIG. 12A, the above players scores are entered on the scoring card.

$2^{nd}$ Hole Play

Point the backstop arrow to the second tee T2.

Player scoring the most points on hole #1 (or the prior hole) get "honors" and starts the tee off.

Player 1 holes in 2 strokes but he moved the backstop. (Dirty bird) 1 point Player 2 holes in 3 strokes and did not move the backstop. (Clean triple) 0 points Player 3 holes in 4 strokes and did not move the backstop. (Clean four) 0 points Player 4 holes in 6 strokes and he moved the backstop. (Dirty six) 0 points Player 1 holed in fewest strokes and will be the only player who gets points.

Since he moved the backstop during hole #2, he is "dirty" and can receive 1 point only.

Referring now to FIG. 12B, the above players scores are entered on the scoring card.

Play continues through 9 (or 18) holes. Remember to point the arrow 16 on the backstop 9 toward the next tee before teeing off.

When a player gets a hole in one, he receives 3 points and the other remaining players are compelled to get a hole in one (to tie) and receive 3 points, otherwise the hole is over. Point the backstop arrow toward the next tee and, of course, the person who aced gets "honors".

Backstop Strategy

In a first embodiment, each player may move the backstop 9 one time per hole when it is his turn to shoot and before he takes his stroke. He can only move the backstop 9 before his stroke (possibly, if he so chooses, making his shot easier because the backstop fence 11 is positioned away from where his ball lies thus creating a 'backstop' that will assist in keeping his ball in the cup 2). Once he chooses to move the backstop 9, he is "dirty" and can only receive one (1) point in that particular hole (assuming he has or ties the lowest score for that hole). Once a player holes the ball, if he has not moved the backstop 9 yet in that particular hole, he may move the backstop fence 11 to make his opponents shot more difficult. If he chooses not to move the backstop 9 after he holes the ball, his right to move the backstop fence 11 is relinquished until the next hole.

In a second embodiment, the backstop 9 may be moved after the player takes his stroke, thus to block a subsequent players line of play to the cup 2. In a third embodiment each player may move the backstop 9 either before or after his stroke (to be agreed on by the players before commencing play), and on each and every stroke he is entitled to. It should be apparent to others equally skilled in the art that the tactics of the game will be altered depending on whether and when a player is allowed to rotate the backstop. A further tactical consideration will be if players are either paired or grouped into teams.

Like any game with rules, players are free to design a backstop strategy that is comfortable for their own play Such modifications and enhancements of backstop play are part of this invention.

Thus it can be seen that the backstop may be moved to make a particular shot easier for that player or may be used to block out a subsequent player.

Additional Rules

When stroking the ball, there must be a measurable back swing of the club. This comes into play especially when the ball is very close or touching the ramp 13 of the cup 2 (rimming).

During play, a player has the right to ask any another player what he lies. If that player has stroked the ball twice, he will say, "I lay 2" or if he has already moved the backstop he will say "dirty two".

Player farthest from the hole always continues play. If there is a question as to who is farthest, one may measure. One may use a tape measure or the club can be used to measure by placing it on the ground and starting from the rim 18 of the cup 2. Flip the club, end over end towards the ball. If the distances are equal, the player who stroked last continues play.

It is possible, (but difficult) to hole the ball over the backstop. A backstroke must occur and (on the forward stroke) a slight up motion is allowed with the club. The club cannot drag over the cup 2, nor can the club carry the ball 5-7 over the fence 11.

Balls must always retain their position and not be moved out of the way during play.

Pop Jolf!™

Figure 9:
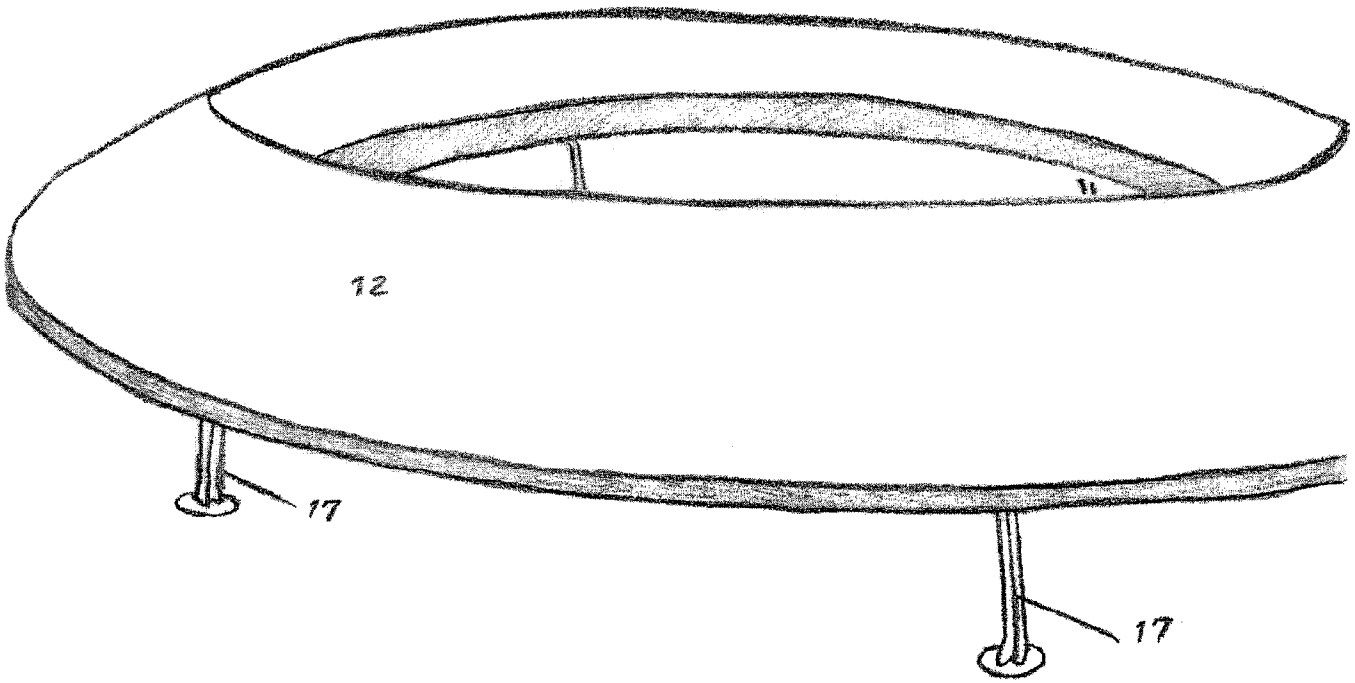
FIG. 9 is a photograph showing the legs installed on the target donut.
Figure 10:
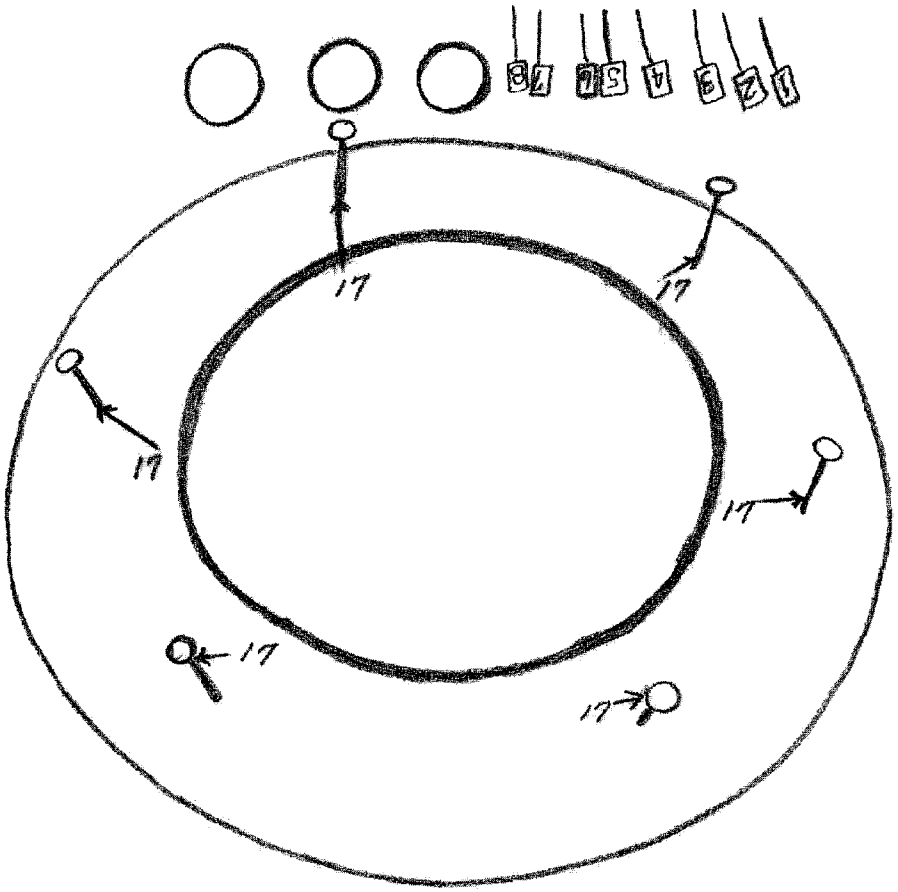
FIG. 10 is a photograph showing the target donut underside with the legs installed.

Referring now to FIGS. 9 & 10, a new element of the invention is introduced. Elevation legs 17 are installed on the underside of the donut 12. This causes the whole donut 12 and the complete cup 2 (once assembled into the raised donut 12) to be elevated off the ground approximately four inches as shown in FIG. 9.

By using the elevation legs included in the game, one can play Pop Jolf!™ The rules are the same as the invention herein, however, since the cup 2 is elevated, the ball cannot roll into the hole, but must be popped airborne (chipped) into the cup 2.

If a player accidentally or otherwise causes his ball to roll and remain under the cup, he must remove it and take a drop at least one club length from the rim 18 of the cup 2. The player incurs a one stroke penalty for the drop.

Precautions and Warnings

This game is very safe because of the soft spongy balls that are used.

Do not let children use the clubs without adult training and supervision.

Stand clear of the player striking the ball. Standing too close to the player may result in being hit by the club during the back swing and may cause serious trauma and injury.

Do not throw the club. Make sure everyone is aware when you are hitting the ball.

It is possible that the lawn may receive small marks or small divots during play.

GOLF GAME APPARATUS AND METHOD
Rocco Gugliotti
Oakville, CT 06779
List of Elements

| | |
|---|---|
| 1 | Backyard |
| 2 | Cup |
| 3 | Jolf flag |
| T1 | tee 1 |
| T2 | tee 2 |
| T3 | tee 3 |
| T4 | tee 4 |
| T5 | tee 5 |
| T6 | tee 6 |
| T7 | tee 7 |
| T8 | tee 8 |
| T9 | tee 9 |
| 4 | Club |
| 5 | ball 1 (red) |
| 6 | ball 2 (blue) |
| 7 | ball 3 (yellow) |
| 8 | flagpole |
| 9 | backstop |
| 10 | circular disk |
| 11 | curved fence |
| 12 | circular donut |
| 13 | ramp |
| 14 | lip |
| 15 | vertical wall |
| 16 | arrow |
| 17 | leg |
| 18 | ring |
| 19 | hook |
| 20 | ring |
| 21 | post hole |
| 22 | fastening peg |
| 23 | holes |

I claim:

1. A golf game apparatus for playing an outdoor golf game comprising:

a target cup having an annular ring with a ramp rising from an outside perimeter to an inside perimeter of said ring, and a flat horizontal disk rotatably mounted within a circumference of said inside perimeter of said ring, and further comprising a vertical backstop mounted on a perimeter of said disk such that said backstop rotates concurrently with and when said disk moves rotatably.

2. A golf game apparatus as in claim 1 wherein said vertical backstop curvedly follows said disk perimeter for an arc length no greater than pi.

3. A golf game apparatus as in claim 2 wherein said vertical backstop has a vertical height greater than a vertical height of said inside perimeter of said ramp on said annular ring.

4. A golf game apparatus as in claim 3 and further comprising a flag pole vertically mounted in a central location of said disk, and a flag mounted on a top of said pole.

5. A golf game apparatus as in claim 4 wherein a player may optionally grasp said flag pole and rotate it a predetermined angular displacement and said disk and said backstop rotate the same said angular displacement.

6. A golf game apparatus as in claim 1 and further comprising:

a plurality of legs, said legs removably attached to said annular ring so as to raise said target cup off the ground a predetermined distance.

7. A golf game apparatus as in claim 1 and further comprising:

a plurality of through-holes in said annular ring, and a set of stakes appropriately dimensioned to drivably fit into and through said holes and fixedly locate said annular ring at a predetermined location on the ground.

8. A golf game apparatus as in claim 1 wherein a player may optionally grasp said flag pole and rotate it a predetermined angular displacement and said disk and said backstop rotate the same said angular displacement.

9. A golf game apparatus as in claim 1 and further comprising a directional arrow displayed on said horizontal disk pointing in a direction away from said backstop.

10. A golf game apparatus as in claim 9 further comprising an over sized golf ball made of a resilient material.

* * * * *